US008998038B2

(12) United States Patent
Chang

(10) Patent No.: US 8,998,038 B2
(45) Date of Patent: Apr. 7, 2015

(54) SPRAYER ACTIVATION DEVICE

(76) Inventor: Hsu-Hui Chang, New Taipei (TW)

( * ) Notice: Subject to any disclaimer, the term of this patent is extended or adjusted under 35 U.S.C. 154(b) by 592 days.

(21) Appl. No.: 13/431,959

(22) Filed: Mar. 27, 2012

(65) Prior Publication Data

US 2013/0255409 A1 Oct. 3, 2013

(51) Int. Cl.
*F16H 21/18* (2006.01)
*B65D 83/26* (2006.01)

(52) U.S. Cl.
CPC ..... *B65D 83/262* (2013.01)

(58) Field of Classification Search
CPC ..... B65D 83/262
USPC ..... 74/48; 222/182
See application file for complete search history.

(56) References Cited

U.S. PATENT DOCUMENTS 4,235,373 A * 11/1980 Clark ..... 239/34
5,038,972 A * 8/1991 Muderlak et al. ..... 222/25
5,249,718 A * 10/1993 Muderlak ..... 222/642
6,036,108 A * 3/2000 Chen ..... 239/274
2006/0076366 A1* 4/2006 Furner et al. ..... 222/402.13
2013/0264361 A1* 10/2013 Chang ..... 222/504

* cited by examiner

*Primary Examiner* — William Kelleher
*Assistant Examiner* — Terence Boes
(74) *Attorney, Agent, or Firm* — Leong C. Lei

(57) ABSTRACT

The sprayer activation device contains a base member, a cover member, and a transmission assembly. The base member provides an accommodation space, an axle, a positioning piece, a through hole, and a number of positioning pins. The transmission assembly contains a motor and a number of engaging transmission gears in the accommodation space. The motor axle is threaded though the through hole of the base member and has an axle gear engaging a transmission gear. A pin is configured on another transmission gear. The cover member seals the accommodation space, and has a positioning pieces and a through slot. A crank is provided with a positioning opening and an axle hole at its two ends, and a hammer is configured at a side of the crank. The hammer is moved up and down as the transmission assembly drives the crank.

10 Claims, 7 Drawing Sheets

SPRAYER ACTIVATION DEVICE

TECHNICAL FIELD OF THE INVENTION

The present invention is generally related to aerosol or liquid sprayers or spray cans such as air fresheners, deodorizers, etc., and more particular to a device for automatically activating a sprayer to spray.

DESCRIPTION OF THE PRIOR ART

In order to improve the quality of air in a closed space such as in an office, in a car, or in a toilet, people often use air conditioners or air cleaners, or use air fresheners, deodorizers, or various kinds of refreshing sprayers to remove odor in the air.

A conventional device for activating a sprayer contains a base, a gear set, an eccentric wheel and block assembly, a circuit board, a control switch, a motor, etc. The base is for housing the various components and has various pins for positioning the motor, circuit board, and gears. The base also has a guiding rail for the block, an indentation for the control switch, etc. The gear set is configured on the base and is coupled to a transmission mechanism of the eccentric wheel by the motor. The eccentric wheel and block assembly has the eccentric wheel configured in an elongated slot in the center of the block. When the eccentric wheel turns, the block is forced to move linearly up and down. The block also has a pressing plate extended from a side. The base has a C-shaped clip for clamping the sprayer so that, when the block is moved downward, the block would effectively contact and press the sprayer's nozzle. On the other hand, when the pressing plate is moved to its topmost position, it will engage the control switch which triggers the circuit board to stop the motor. A timer of the circuit board will expires later and activates the circuit board to start the motor again. As such, the device is capable of activating the sprayer to spray periodically.

The disadvantage of the device is that, when the block is moved downward to press the nozzle, the motor has to consume a lot of electricity so as to produce the kind of pressure similar to human finger.

SUMMARY OF THE INVENTION

Therefore, a major objective of the present invention is to provide a novel sprayer activation device whose motor is required to exert only limited force.

A secondary objective of the present invention is to provide a novel sprayer activation device applicable to both liquid and aerosol sprayers.

To achieve the foregoing objectives, the sprayer activation device contains a base member, a cover member, and a transmission assembly. The base member provides an accommodation space, an axle, a positioning piece, a through hole, and a number of positioning pins. The transmission assembly contains a motor and a number of engaging transmission gears in the accommodation space. The motor axle is threaded though the through hole of the base member and has an axle gear engaging a transmission gear. A pin is configured on another transmission gear. The cover member seals the accommodation space and is joined to the base member by fastening elements. The cover member also has a positioning pieces and a through slot. A crank is provided with a positioning opening and an axle hole at its two ends, and a hammer is configured at a side of the crank. The hammer is moved up and down as the transmission assembly drives the crank.

Specifically, the positioning pieces of the base and cover members are positioned in parallel with respective through holes.

Specifically, the transmission assembly contains a motor, a first transmission gear, a second transmission gear, and a third transmission gear.

Specifically, the first and second transmission gears are circular gears whose teeth are configured along the circumferences and whose axles have through axial channels and teeth around the circumferences. The third transmission gear is a fan-shaped gear whose teeth are configured on the arc circumference. A positioning hole is configured at the circular centre of the third transmission gear, and a pin is configured adjacent to the teeth. The teeth of the first transmission gear's axle engage the circumferential teeth of the second transmission gear; and the teeth of the second transmission gear's axle engage the arc teeth of the third transmission gear.

Specifically, the hammer of the crank is positioned between the positioning pieces of the cover and base members.

Specifically, the positioning opening of the crank is a slant and rectangular opening.

Specifically, the motor is configured with a control switch coupled to the top end of the axle of the base member. The control switch could be a mechanical button or a photosensitive sensor.

Specifically, the motor is a DC (direct current) motor.

The advantages of the present invention are as follows.

Firstly, the transmission assembly achieves power saving by utilizing four gears and a crank.

Secondly, the sprayer activation device is applicable to both aerosol and liquid sprayers.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
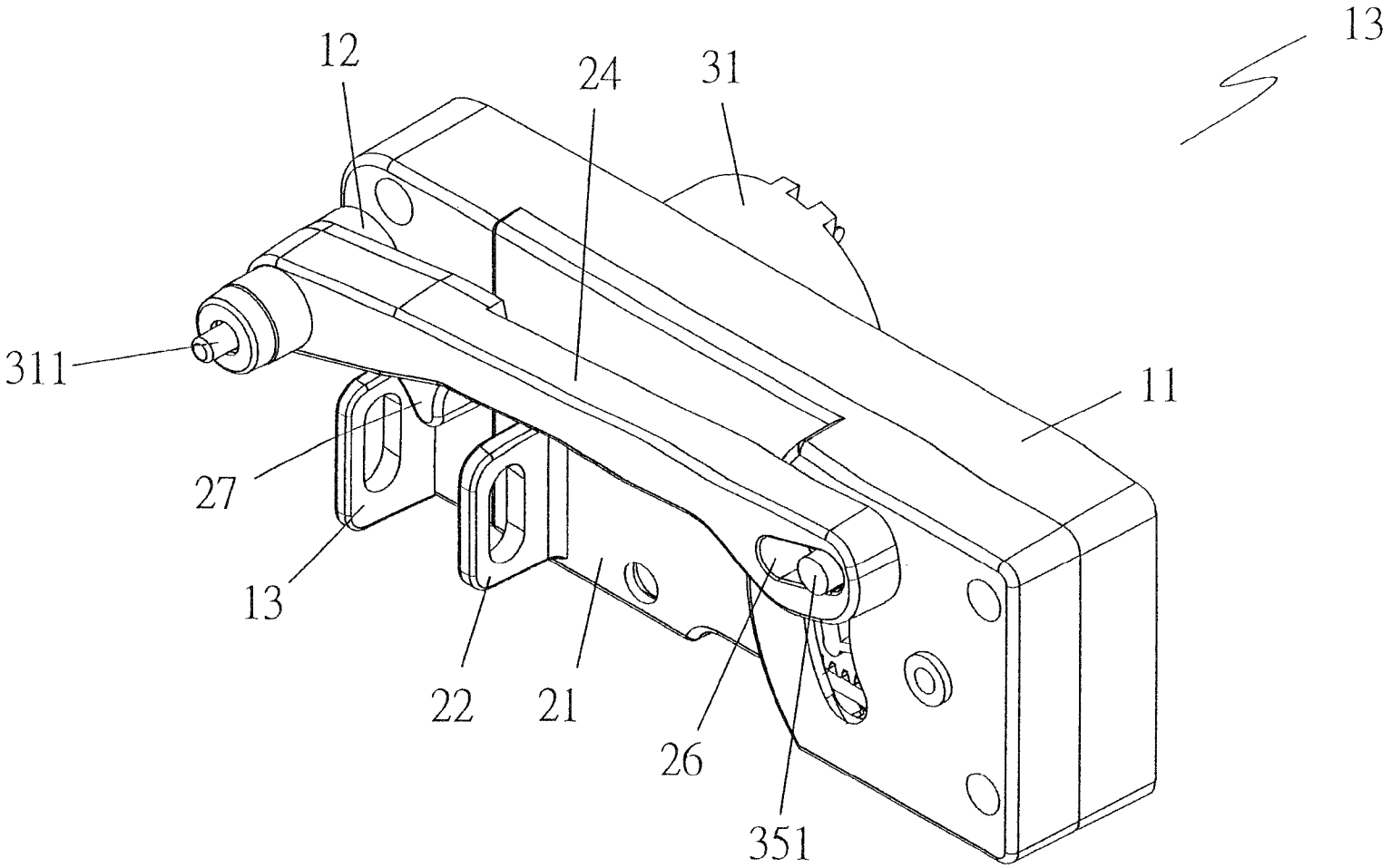
FIG. 1 is a perspective diagram showing a sprayer activation device according to an embodiment of the present invention.
Figure 2:
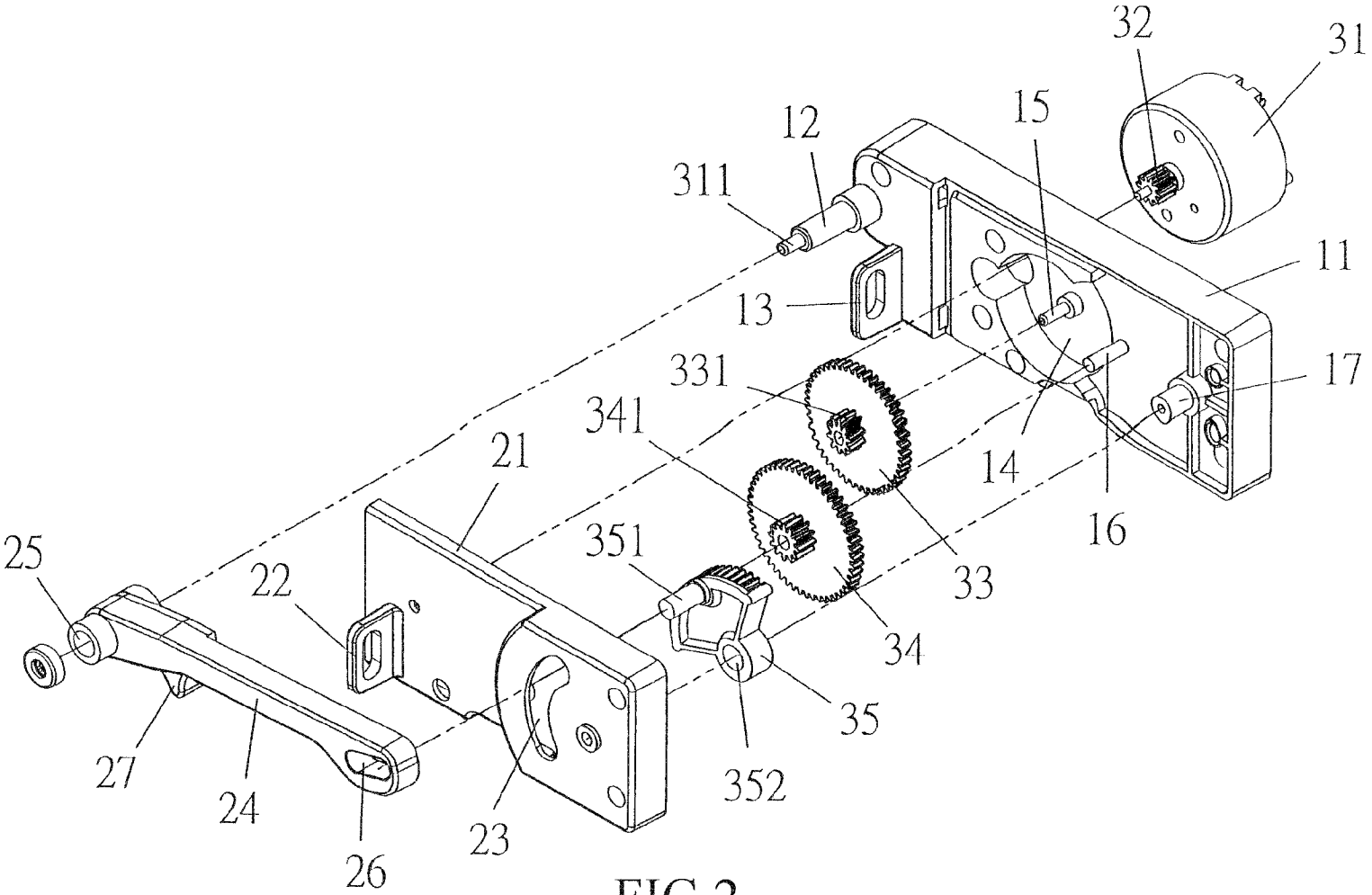
FIG. 2 is a perspective break-down diagram showing the various components of the sprayer activation device of FIG. 1.

As shown in FIGS. 1 and 2, a sprayer activation device 1 according to an embodiment of the present invention contains a base member 11, a cover member 21, and a transmission assembly. The base member 11 has an accommodation space on an inner side. Besides the accommodation space, the inner side has an axle 12 and a positioning piece 13 with a through hole. Inside the accommodation space, there is a through hole 14, a first positioning pin 15, a second positioning pin 16, a third positioning pin 17, and a number of bolt holes.

Figure 3:
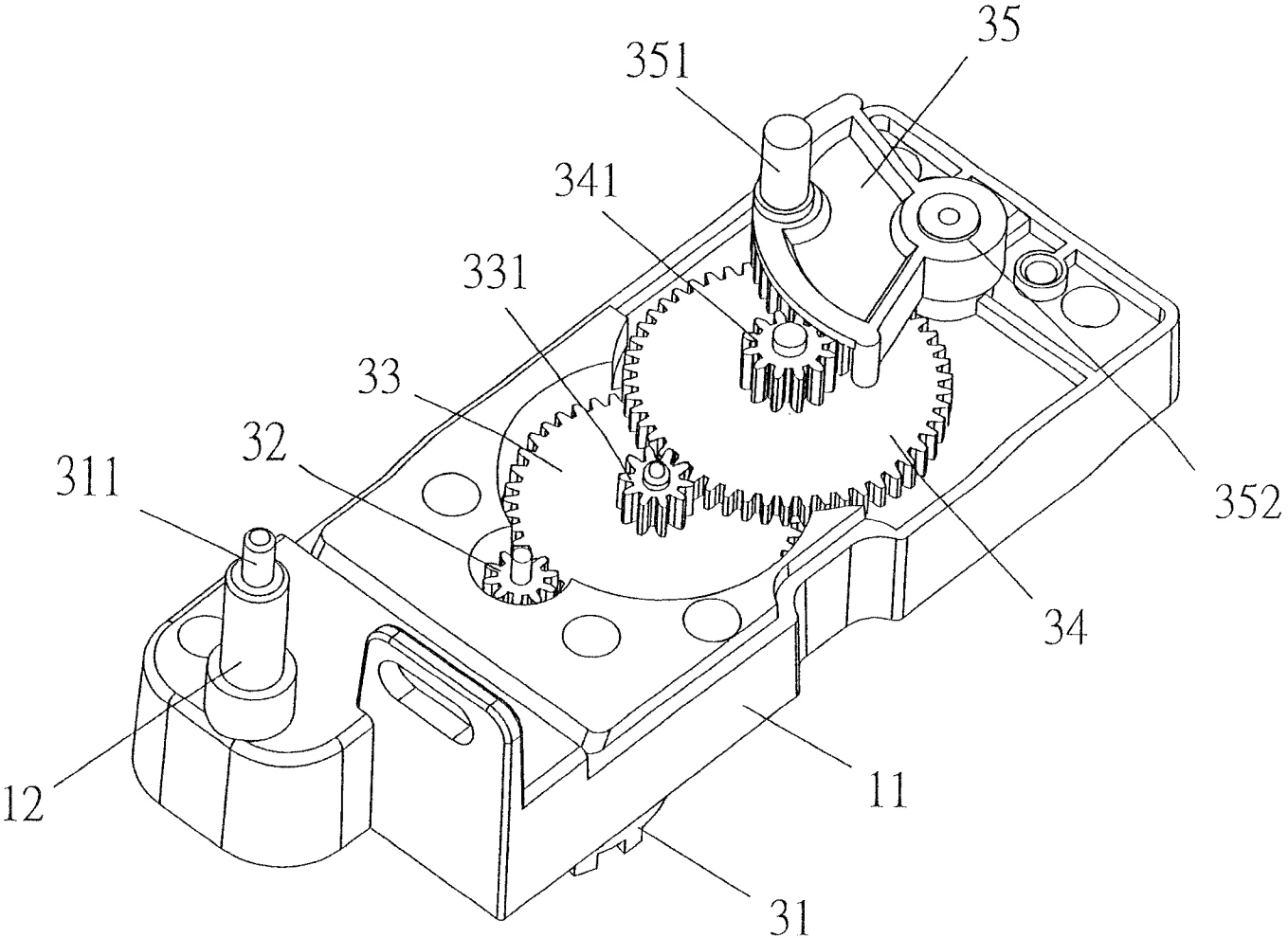
FIG. 3 is a perspective diagram showing how the transmission assembly is configured on the base member of the sprayer activation device of FIG. 1.

The transmission assembly contains a motor 31, a first transmission gear 33, a second transmission gear 34, and a third transmission gear 35. The motor 31 is a DC (direct current) motor whose axle threads through an axle gear 32. The first and second transmission gears 33 and 34 are circular gears whose teeth are configured along the circumferences and axles 331 and 341 have through axial channels and teeth around the circumferences. The third transmission gear 35 is a fan-shaped gear whose teeth are configured on the arc circumference. A positioning hole 352 is configured at the circular centre of the third transmission gear 35, and a pin 351 is configured adjacent to the teeth. The motor 31 has its axle gear 32 threaded through the through hole 14 and is joined to a back side of the base member 11. The first and second positioning pins 15 and 16 are threaded through the through channels of the axles 331 and 341 of the first and second transmission gears 33 and 34, respectively. Similarly, the third positioning pin 17 is threaded through the positioning hole 352 of the third transmission gear 35. Then, the teeth of the axle gear 32 engage the circumferential teeth of the first transmission gear 33; the teeth of the first transmission gear 33's axle 331 engage the circumferential teeth of the second transmission gear 34; and the teeth of the second transmission gear 34's axle 341 engage the arc teeth of the third transmission gear 35, as shown in FIG. 3. A control switch 311 to the motor 31 is configured in the axle 12 of the base member 11, which could be a mechanical button or a photosensitive sensor.

The cover member 21 is for sealing the accommodation space of the base member 11, and the cover member 21 has a number of bolt holes, a through slot 23, and, on a front side, a positioning piece 22 with a through hole. The cover member 21 and the base member 11 are joined together by a number of fastening elements through their aligned bolt holes. The pin 351 is exposed through the through slot 23, and the positioning pieces 13 and 22 of the base and cover members 11 and 21 stand in parallel with an appropriate distance. A crank 24 is provided with a positioning opening 26 and an axle hole 25 at the crank 24's two ends, and a hammer 27 at a side of the crank 24. The axle hole 25 is joined to and threaded by the axle 12 of the base member 11. On the other hand, the pin 351 is inserted into the slant rectangular positioning opening 26 of the crank 24, and the hammer 27 is positioned in the gap between the positioning pieces 13 and 22.

Figure 4:
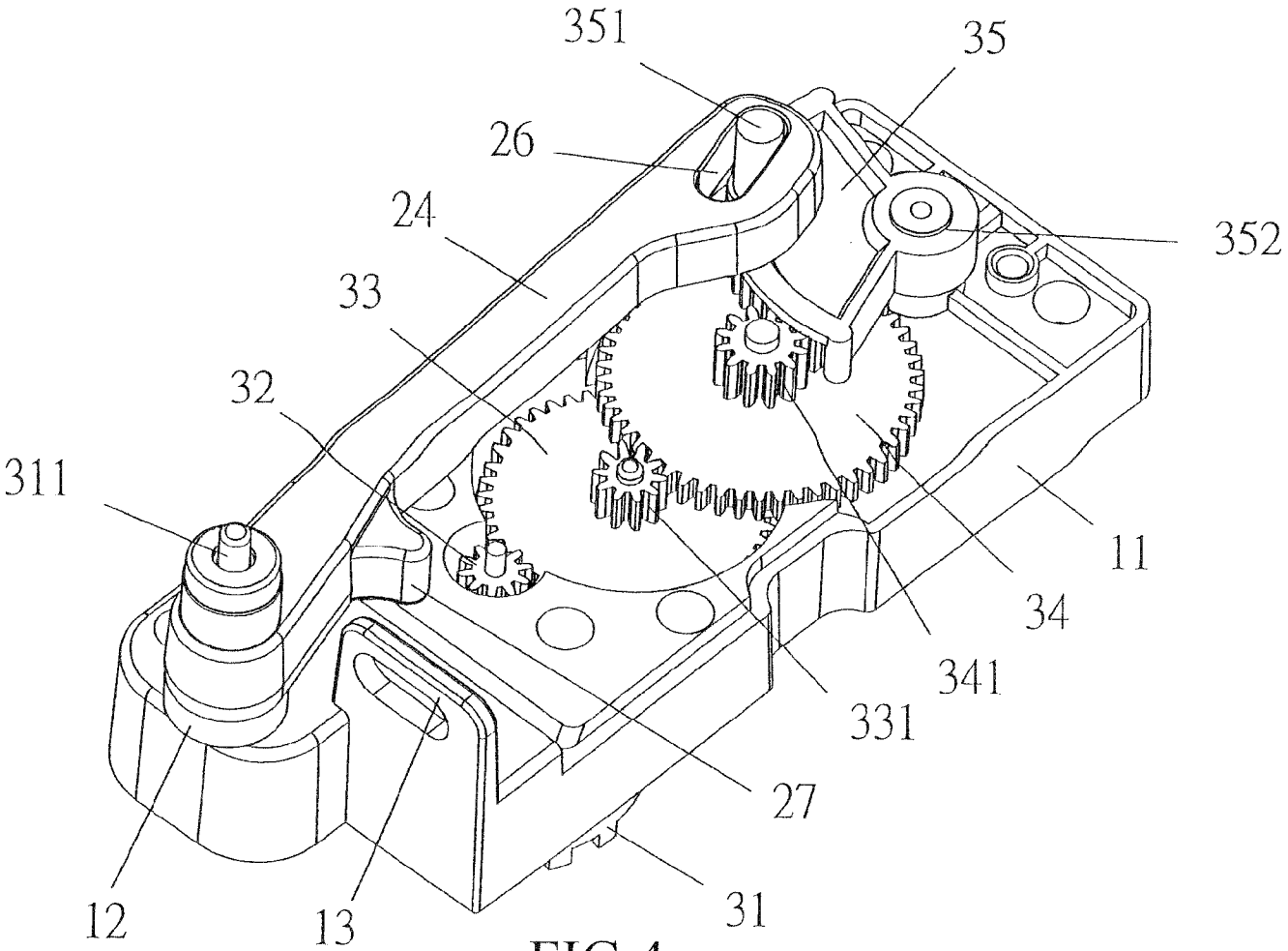
FIGS. 4 and 5 are perspective diagrams showing how the transmission assembly of the sprayer activation device of FIG. 1 operates.
Figure 5:
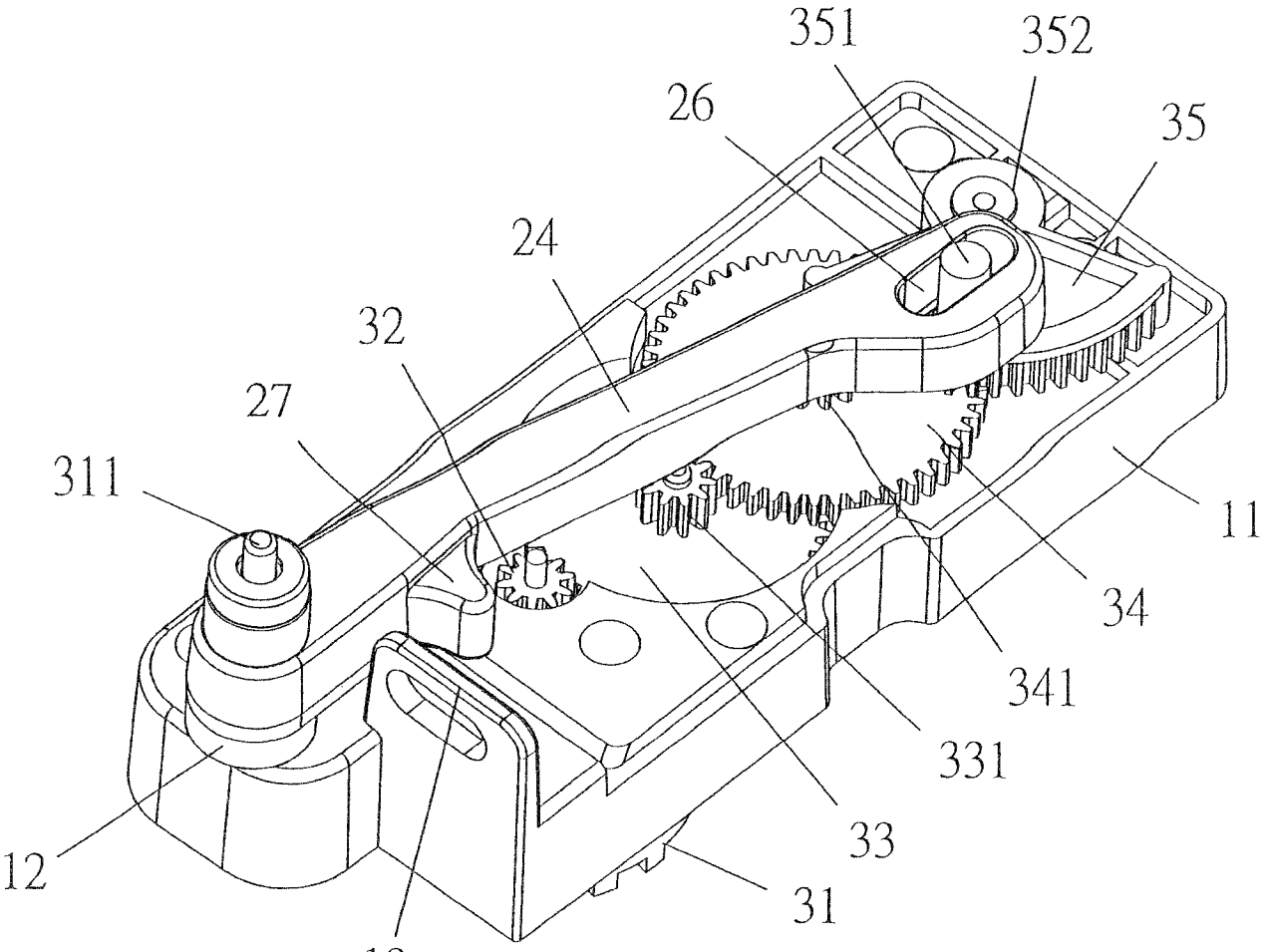
Figure 6:
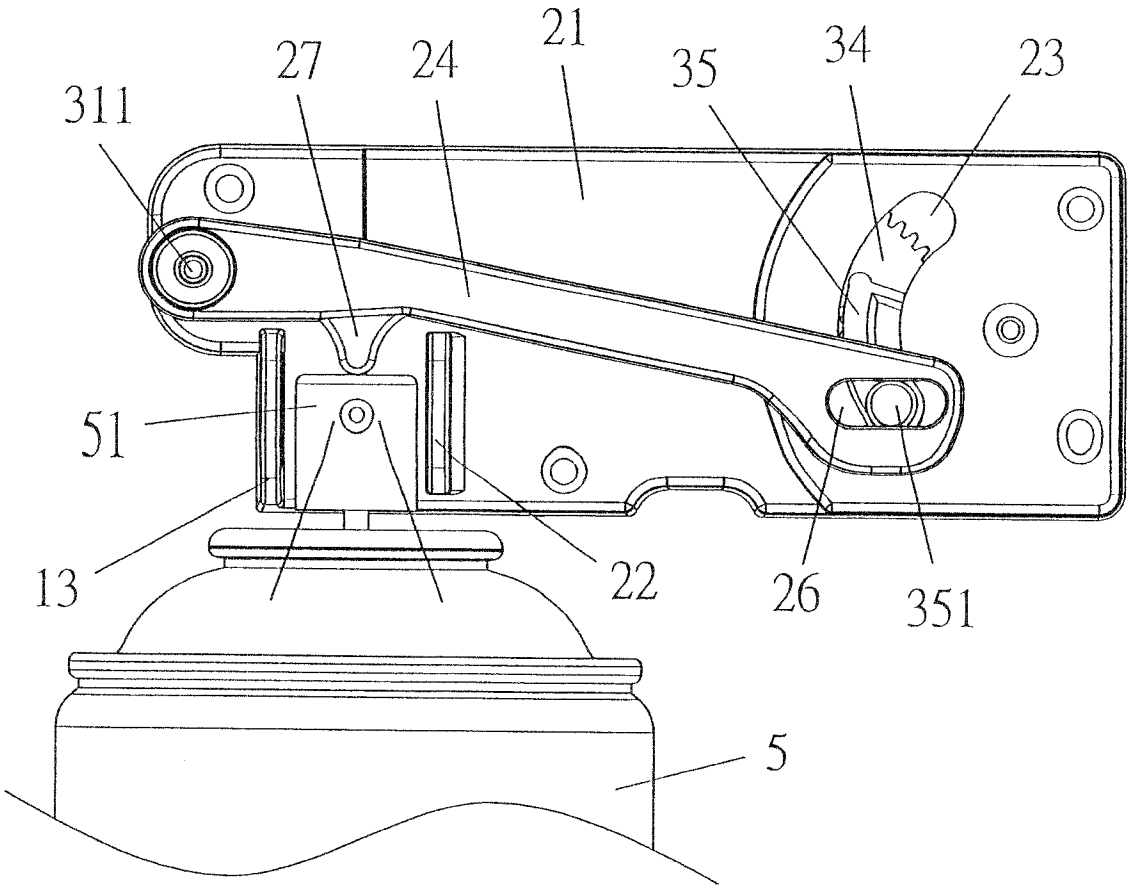
FIG. 6 is a side-view diagram showing the sprayer activation device of FIG. 1 installed on an aerosol sprayer.
Figure 7:
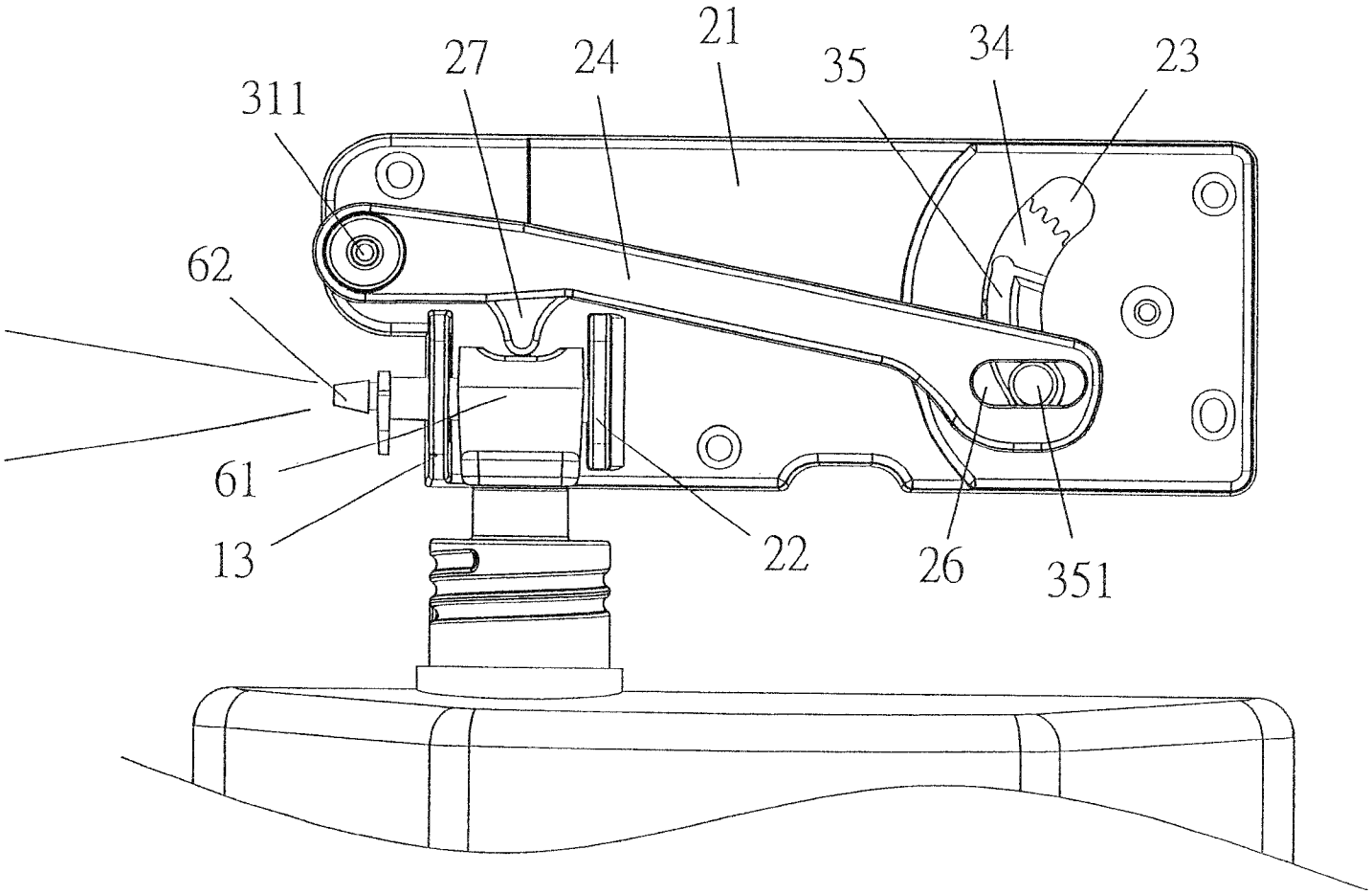
FIG. 7 is a side-view diagram showing the sprayer activation device of FIG. 1 installed on a liquid sprayer.

As shown in FIGS. 4 and 5, when the control switch 311 of the motor 31 is engaged to activate the motor 31, the axle gear 32 drives the first transmission gear 33 whose axle 331 synchronously drives the second transmission gear 34 whose axle 341 in turn synchronously drives the third transmission gear 35. When the third transmission gear rotates, its pin 351 moves within the positioning opening 26 of the crank 24 and thereby drives the crank 24 as well as its hammer 27 to move up and down in repeated cycles. Then, as shown in FIG. 6, by positioning the depressing head 51 of an aerosol sprayer 5 between the positioning pieces 13 and 22, the cyclic movement of the hammer 27 presses the depressing head 51 to spray the refreshing aerosol in the sprayer 5 periodically. As shown in FIG. 7, a liquid sprayer 6 has its nozzle 62 threaded through the through hole of the positioning piece 13 and its depressing head 61 positioned between the positioning pieces 13 and 22. Then, as the motor 31 is activated, the crank 24 is driven through the transmission gears to move the hammer 27 up and down periodically. Whenever the hammer 27 pushes the depressing head 61, the liquid in the sprayer 6 is sprayed.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A sprayer activation device, comprising a base member, a cover member, and a transmission assembly: wherein the base member has an accommodation space inside, an axle, a positioning piece, a through hole, and a plurality of positioning pins;

the transmission assembly contains a motor and a plurality of transmission gears engaging each other in the accommodation space; the motor axle is threaded though the through hole of the base member and has an axle gear engaging a transmission gear;

a pin is configured on another transmission gear;

the cover member seals the accommodation space and is joined to the base member by fastening elements through a plurality of bolt holes on the cover and base members; the cover member has a positioning piece and a through slot; and the transmission assembly further contains a crank with a positioning opening and an axle hole at its two ends, respectively; the crank has a hammer configured at a side of the crank; and the hammer is moved up and down as the transmission assembly drives the crank.

2. The sprayer activation device according to claim 1, wherein the positioning pieces of the base and cover members are positioned in parallel with respective through holes in the centre.

3. The sprayer activation device according to claim 2, wherein the positioning pieces of the cover and base members are for joining the sprayer activation device to an aerosol or liquid sprayer.

4. The sprayer activation device according to claim 1, wherein the transmission assembly contains a motor, a first transmission gear, a second transmission gear, and a third transmission gear.

5. The sprayer activation device according to claim 4, wherein the first and second transmission gears are circular gears whose teeth are configured along the circumferences and whose axles have through axial channels and teeth around the axles' circumferences; the third transmission gear is a fan-shaped gear whose teeth are configured on the arc circumference; a positioning hole is configured at the circular centre of the third transmission gear; a pin is configured adjacent to the third transmission gear's teeth; the teeth of the first transmission gear's axle engage the circumferential teeth of the second transmission gear; and the teeth of the second transmission gear's axle engage the arc teeth of the third transmission gear.

6. The sprayer activation device according to claim 1, wherein the hammer of the crank is positioned between the positioning pieces of the cover and base members.

7. The sprayer activation device according to claim 1, wherein the positioning opening of the crank is a slant and rectangular opening.

8. The sprayer activation device according to claim 1, wherein the motor is coupled to a control switch which is configured to a top end of the base member's axle.

9. The sprayer activation device according to claim 8, wherein the control switch is one of a mechanical button and a photosensitive sensor.

10. The sprayer activation device according to claim 1, wherein the motor is a DC motor.

* * * * *